US006984184B2

(12) United States Patent
Gray

(10) Patent No.: US 6,984,184 B2
(45) Date of Patent: Jan. 10, 2006

(54) BASEBALL BATTING SWING TRAINING APPARATUS AND METHOD OF USING SAME

(76) Inventor: Jonathan D. Gray, 4127 Farquhar Ave., Los Alamitos, CA (US) 90720

( * ) Notice: Subject to any disclaimer, the term of this patent is extended or adjusted under 35 U.S.C. 154(b) by 0 days.

(21) Appl. No.: 10/915,019

(22) Filed: Aug. 10, 2004

(65) Prior Publication Data

US 2005/0009647 A1 Jan. 13, 2005

Related U.S. Application Data

(60) Continuation of application No. 10/670,921, filed on Sep. 25, 2003, now Pat. No. 6,773,366, which is a division of application No. 09/909,355, filed on Jul. 18, 2001, now abandoned.

(51) Int. Cl.
*A63B 67/00* (2006.01)
*A63B 69/00* (2006.01)

(52) U.S. Cl. ..... 473/458; 453/464

(58) Field of Classification Search ..... 473/212–213, 473/229, 248, 422, 450, 453, 458, 464, DIG. 30, 473/207, 451; 273/DIG. 30; 24/301, 200, 24/300

See application file for complete search history.

(56) References Cited

U.S. PATENT DOCUMENTS

| | | | | |
|---|---|---|---|---|
| 1,655,092 A | | 1/1928 | Davis | |
| 2,450,162 A | | 9/1948 | Proman | |
| 4,019,734 A | * | 4/1977 | Lee et al. | 482/125 |
| 4,377,284 A | | 3/1983 | Okerlin | |
| 4,757,995 A | * | 7/1988 | Gallagher | 473/458 |
| 4,896,887 A | | 1/1990 | Cable | |
| 5,005,833 A | * | 4/1991 | Groveman et al. | 473/464 |
| 5,076,587 A | | 12/1991 | Manley | |
| 5,114,142 A | | 5/1992 | Gillespie | |
| 5,154,416 A | | 10/1992 | Small et al. | |
| 5,188,365 A | | 2/1993 | Picard | |
| 5,348,292 A | * | 9/1994 | Norman, Sr. | 473/438 |
| 5,360,209 A | | 11/1994 | Mollica et al. | |
| 5,472,206 A | | 12/1995 | Manley | |
| 5,601,285 A | * | 2/1997 | Baxter, III | 473/458 |
| 5,704,856 A | | 1/1998 | Morse | |
| 5,807,218 A | | 9/1998 | Nagatomo | |
| 5,813,954 A | * | 9/1998 | Wilkinson | 482/124 |
| 5,839,978 A | * | 11/1998 | Evangelist | 473/458 |
| 5,865,685 A | | 2/1999 | Thomas | |
| 5,902,189 A | | 5/1999 | Schultz | |
| 5,938,548 A | * | 8/1999 | Upshaw | 473/453 |
| 6,095,936 A | * | 8/2000 | Kirkpatrick et al. | 473/450 |
| 6,354,355 B1 | * | 3/2002 | Ragouzis | 160/368.1 |
| 6,514,163 B2 | * | 2/2003 | Burns | 473/458 |
| 6,773,366 B2 | * | 8/2004 | Gray | 473/458 |

FOREIGN PATENT DOCUMENTS

GB 281171 12/1927

* cited by examiner

*Primary Examiner*—Nini F. Legesse
(74) *Attorney, Agent, or Firm*—Fulwider Patton Lee & Utecht LLP

(57) ABSTRACT

An apparatus for building muscle memory to develop a more rapid baseball swing and avoid casting of the hands and bat during the swing. Such apparatus includes a first attachment member connectable to an upper arm and a second attachment member connectable to an opposing forearm interposed by an elongated tether to be aligned along a forearm upon initially entering into a hitter's stance. A method for using such apparatus is also disclosed herein.

2 Claims, 10 Drawing Sheets

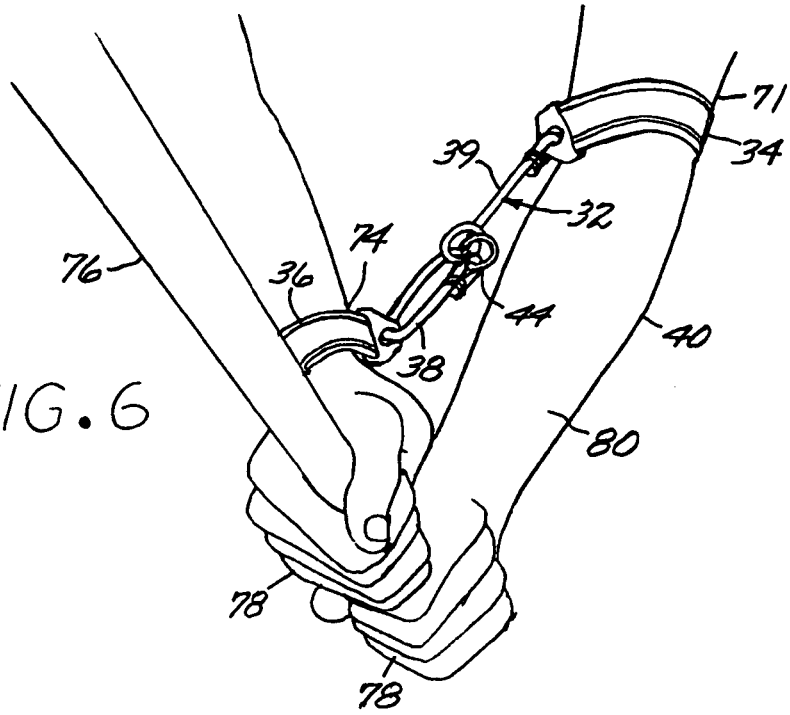
FIG. 6
FIG. 7
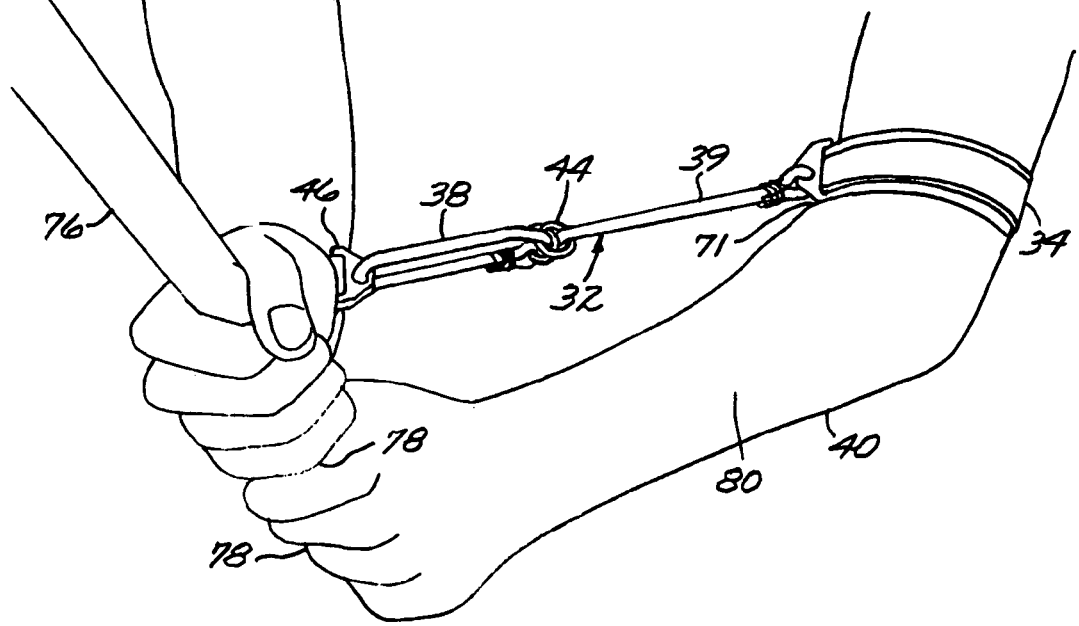

BASEBALL BATTING SWING TRAINING APPARATUS AND METHOD OF USING SAME

This is a continuation application of U.S. Ser. No. 10/670,921, now U.S. Pat. No. 6,773,366, entitled Baseball Swing Training Apparatus and Method of Using Same, filed on Sep. 25, 2003, which is in turn a divisional of U.S. Ser. No. 09/909,355, also entitled Baseball Swing Training Apparatus and Method of Using Same, filed on Jul. 18, 2001, now abandoned, which are both incorporated herein by reference in their entireties.

BACKGROUND OF THE INVENTION

1. Field of the Invention

The invention relates generally to athletic training devices and more specifically to baseball swing training devices for developing a short compact swing.

2. Description of the Prior Art

The application of the continued study of body mechanics has resulted in numerous devices purporting to maximize the desired effect of a particular motion. Such devices are particularly evident in the sporting industry. However, as the motions required in each sport provide a unique set of mechanics, the instruments are typically specifically tailored to improving a precise motion for a particular sport and often a specific motion.

For example, in baseball or softball, several attempts have been proposed to allegedly improve a batter's swinging motion. One such device focuses on training the batter to shift his weight during his swing and can be found in U.S. Pat. No. 5,704,856 to Morse. This reference discloses a pair of straps spaced apart by an elongated two-piece connective member having a length adjustable portion with a release buckle and an elastic portion. Such straps are respectively connected to the lead forearm and lead leg above the knee. By moving the lead arm rearwardly and upwardly at the beginning of the swing, the lead leg, which is coupled to the lead arm, is pulled upwardly and rearwardly such that the batter must shift his or her weight to the back leg to maintain a balanced stance. As the swing progresses, the lead arm is lowered and the batter is able to shift his weight forward to the front leg. The length of such device must accommodate the placement of the two straps on the lead arm and lead leg which results in a significant slackened portion as the batter advances through the swing. While such section is slackened, the device does not assist the batter's swing motion. The focus of such device is on weight transfer and does not improve upper body swing mechanics.

Another such device can be found in U.S. Pat. No. 5,154,416 to Smull et al. This bottom swing developer includes a harness having a pair of loops through which the arms are placed. The loops are worn against the body and connected across the torso in front and back of the batter. A restraining member having a predetermined length connects the wrist of the top hand to the harness to purportedly restrict the top hand from dominating the batting swing. Such device appears to constrict the batter's swing by inhibiting a complete follow through due to restraining the top hand from turning over and preventing the top arm from fully extending.

In addition to weight transfer and maintaining equal balance in the hands, it is often desirable in baseball or in softball, to develop a short compact swing such that the arms are kept in tight to the body for a significant portion of the swing path enabling the batter to guide the bat with increased accuracy in relation to the incoming ball and get the bat around in a hurry by avoiding wasted motion. Such a swing avoids casting related injuries such as bad backs and being hit by pitches due to an overextension of the arms. By developing a short compact swing, the distance the bat must travel is reduced and thus the batter may also benefit from increased swing speed.

One such device which attempts to address swing characteristics is illustrated in U.S. Pat. No. 5,114,142 to Gillespie et al. The training device disclosed in Gillespie includes a belt encircling the chest of the batter and second belt for encircling the batter's upper arm. The two belts are connected by a short length of material to secure the encircled upper arm close to the body in a locked in position throughout the swing while allowing the respective forearm to produce some movement to effect a swing of the bat. The device alleges to promote proper hip and top hand action to generate more power. However, it is apparent that the batter is severely restricted in his swing and can not direct his hands across his chest as is desirable in a short compact swing.

Another device which takes an alternative approach to improving swing characteristics is shown in U.S. Pat. No. 5,260,209 to Mollica. Such device is used in lieu of a conventional bat and includes a handle connected to a cylindrical stem extending from the handle and terminating in a stop. A weighted member is slidably mounted to the stem and allegedly moves into a correct position upon establishing a proper swing. Incorrect movement of the weighted member is purported to indicate an error in the swing. Since such training device is used in lieu of a baseball bat, the user is prevented from practicing while hitting an actual ball.

Another common theme appearing in each of these devices is the lack of any indication of the proper starting position. As the initial set up of the swing path is critical in developing a consistent swing, a lack of indication of the proper starting position is a serious shortcoming.

What is needed and heretofore unavailable is an easy to use baseball swing training device which provides an indication of the proper starting position and builds muscle memory to develop a short compact swing for increased hitting accuracy. Such device should inhibit introduction of poor swing characteristics and also be relatively inexpensive, easy to manufacture, and adjustable to any number of body profiles.

SUMMARY OF THE INVENTION

In accordance with the present invention, a batting swing training apparatus is provided having an adjustable elongated tensioning member interposed between a first adjustable attachment member which may be connected to the lead arm of the batter at a point above the elbow and a second attachment member which may be connected to the trailing arm of the batter at the wrist during use. Such an apparatus may be donned to impart muscle memory and train a batter in the proper swing mechanics by inducing a tension at critical swing positions to produce a proper initial swing position and subsequent motion through critical points during the swing.

Methods for using such apparatus to provide a visual indicator of a proper starting position, prevent unwanted casting motion, and accelerating through the contact point of the swing are also described herein.

BRIEF DESCRIPTION OF THE DRAWINGS

FIG. 6 is an elevated front view of a batter gripping a bat while wearing the preferred embodiment of the present invention;

FIG. 7 is an elevated front view of the batter wearing the preferred embodiment of the present invention illustrating an improper alignment;

Numerous advantages and aspects of the invention will be apparent to those skilled in the art upon consideration of the following detailed description and attached drawing figures referenced therein.

DETAILED DESCRIPTION OF THE PREFERRED EMBODIMENT

Figure 1:
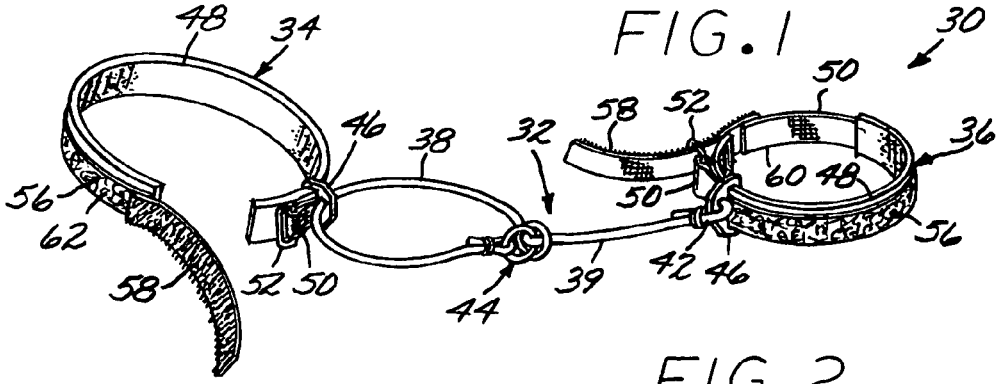
FIG. 1 is a perspective view of a preferred embodiment of the present invention.
Figure 4:
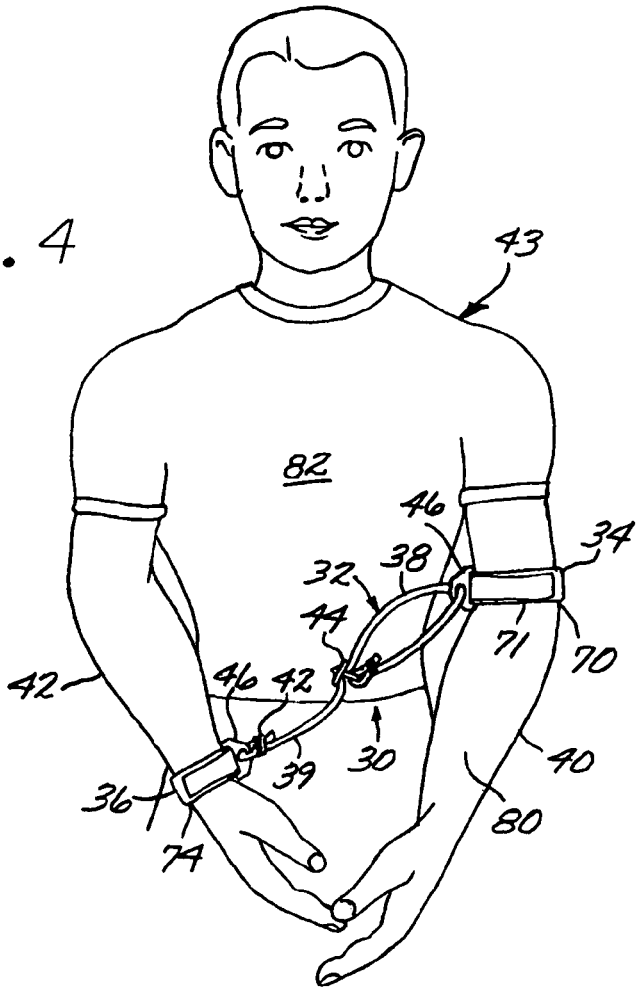
FIG. 4 is a front view of a batter, in reduced scale, illustrating the attachment points of the preferred embodiment of the present invention illustrated in FIG. 1.

Referring now to FIGS. 1 and 4, a baseball swing training device, generally designated 30, includes an adjustable, elongated, elastic tensioning member 32 comprising adjacent sections having a first attachment member 34 attached to one of its sections and a second attachment member 36 attached to the opposing section. The training device is connectable to the leading arm 40 and trailing arm 42 of a batter 43 to develop a proper swinging motion by reinforcing a batter's muscle memory corresponding to a preferred batting swing. For purposes of this invention "baseball" will be understood to refer to any baseball-like game, such as softball, over-the-line, stickball and the like. "Leading arm" will be understood to mean that arm on the side from the ball is delivered. For example the leading arm of a right handed batter is the left arm.

The tensioning member 32 is constructed of a single piece of an elastic material with a cloth covering and preferably is a section of a bungee cord which can purchased from Bungee International Mfg. Corp in Chatsworth, Calif. The tensioning member 32 is preferably about 12 to 20 inches long in an unstretched condition and may stretch up to a length 36 inches long. These unstretched and stretched lengths have been found to accommodate a wide range of batter physiques, however, it will be appreciated that other combinations of such lengths may be selected to suitably accommodate different sized batters. It will further be appreciated that alternative stretch resistance characteristics of the tensioning member may be selected to provide a desired tension throughout the swing. The tensioning member is divided into two variable length sections including a first section forming an adjustable loop 38 and a second section providing a stretchable length of cord 40 terminating in an anchor loop 42. Such anchor loop is formed by doubling back a relatively short length of the tensioning member in the stretchable section 39 and securing the loop with a clamping ring 41.

Separating the sections at an intermediate point along the length of the tensioning member is a slip ring assembly 44 including a pair of metallic rings which allows a portion of the cord in either section to be passed through to adjust the size of the adjustable loop 38 making its respective diameter smaller or larger as desired and respectively lengthening or shortening the length of the cord 40. The slip ring assembly 44 pinches the tensioning member and frictionally retains the two adjacent sections of the tensioning member 32 so that no slippage will occur and maintain the respective sections in a desired configuration. By separating the rings in the slip ring assembly, a length of the tensioning member 32 may pass through the rings to adjust the overall length of the tensioning member. The tensioning member and slip ring combination may also be purchased at Bungee International Mfg. Corp in Chatsworth, Calif. It will be appreciated that the adjustability of the tensioning member 32 provides a training device 30 that is suitable for both children and adults.

Figure 2:
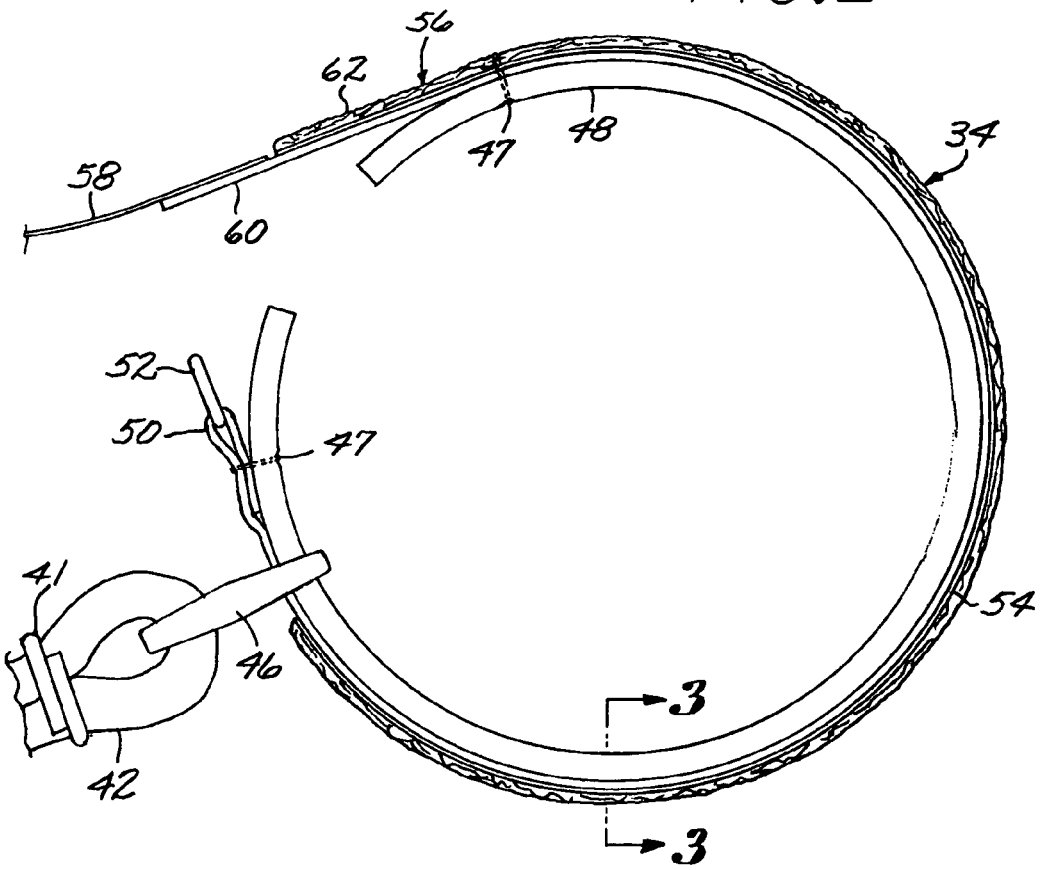
FIG. 2 is a partial view, in enlarged scale, of the embodiment shown in FIG. 1.
Figure 3:
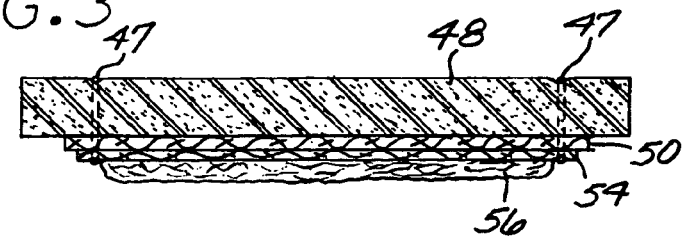
FIG. 3 is sectional view, in enlarged scale, taken along lines 3—3 shown in FIG. 2.

A portion of the adjustable loop 38 is connected to the first attachment member 34 via a double slotted clip 46. More specifically, a section of the adjustable loop passes through one slot of the double slotted clip and a portion of the attachment member 34 passes through the other slot. The first attachment member itself is formed of a multi-layered band. The band includes four layers that are typically stitched together, adhered, or pinned or a combination of any of these three binding devices. For illustrative purposes, pins 47 are shown in FIGS. 2 and 3. These four layers cooperate to form an open ended loop allowing the batter to place his leading arm within the loop. The innermost first layer is a neoprene lining 48 to be placed against the batter's skin or uniform providing a cushioning layer. The second layer 50 is a nylon or woven cloth providing strength and terminates at one in a link 52 such as those available from XMSurf More Products located in San Clemente, Calif. These links have angled sides to better resist complete removal of a strip of material placed therein. The third layer 54 provides a bonding surface or anchor for the fourth layer 56 which includes a first fastener 58 formed with a pile material. As illustrated in FIG. 2, the third layer extends beyond the neoprene and woven cloth layers on one end to provide an extension 60 from which a second fastener 62 complementary to the first fastener 58 is secured preferably by a suitable means such as stitching. The first fastener includes a series of hooks on its outer surface as is typically provided in Velcro® fasteners. The first fastener 58 is dimensioned to pass through the link 52 and double back onto the second fastener in an overlapping arrangement to close the loop around the batter's leading arm 40 just above the elbow and resting against the elbow pit 71 (FIG. 4). The length of the first fastener 58 is sufficient to provide additional adjustability depending on the needs of the individual batter. A relatively tight but comfortable fit is preferred which ensures maximum assistance from the swing training device and thus should be adjusted until a snug fit is accomplished.

Connected to the opposing end of the tensioning member 32 is the second attachment member 36 which is similar in construction but is dimensioned to be placed around the wrist 74 of the trailing arm 42 of the batter 43 in training. Typically, the dimensions are not as great and this attachment member is smaller in its maximum diameter than the maximum diameter of the first attachment member 34 because it is only required to fit on the batter's wrist 74. More specifically, the anchor loop 42 of the stretchable section 39 is attached to a double slotted clip as previously described for the first attachment member. All other components of the second attachment member 36 are the same as for the first attachment member except for the dimensions and in referring to the figures, like components are like numbered.

Referring now to FIGS. 4–14, the operation of the training device 30 will now be described in detail. As illustrated in FIG. 4, a batter 43 preparing to practice a right handed hitting motion dons the training device 30 by placing the first attachment member 34 just above the elbow 70 of the leading arm 40 of the batter. More specifically, the attachment of the first attachment member 34 is as follows. Assuming both attachment members are initially unfastened, meaning the second fastener 62 is not connected to the respective first fastener 58, the batter 43 wraps the first attachment member 34 around the lead arm 40 just above the elbow 70 with the neoprene layer 48 facing inwardly and abutting the skin or uniform. The free end of the first fastener 58 is threaded through the clip 52 such that the hooks are facing outwardly. The free end is moved outwardly to fold back onto and mesh with the pile material of the complementary second fastener 58 forming a closed loop with a cushioning inner layer 48 around the batter's upper arm abutting the elbow pit 71 (FIG. 4). As desired, the snugness of the fit may be adjusted by loosening the first fastener 58 from the second fastener 62 and repositioning the amount of overlap of the first fastener with respect to the second fastener and then reattaching the complementary fasteners. When a desired comfort level has been attained, the first attachment member should be abutting the elbow pit 71 of the lead arm 40.

In a similar manner, the open looped second attachment member 36 is wrapped around the wrist 74 of the trailing arm 42 with the neoprene lining 48 on the inside contacting the skin or shirt of the batter. The batter 43 grasps the free end of the first fastener 58 and threads it through the clip 52 of the attachment member 36 (FIG. 1). By folding the first fastener 58 back onto and overlapping the second fastener 62 and placing it thereagainst to fasten the second attachment member 36 to the trailing arm 42 such that the loop is closed and abutting the trailing wrist 74. If an adjustment is desired for a tighter fit, the first fastener 58 may be temporarily released from the second complementary fastener 62 by its free end and pulled through the clip 52 to reduce the diameter of the second attachment member loop. After both attachment members 34 and 36 have been adjusted to provide a comfortable fit, the right handed swinging batter 43 will have the training device 30 positioned as illustrated in FIG. 4.

While the training device 30 is sized to fit a wide cross section of batter proportions with respect to the attachment members 34 and 36, the tensioning member 32 is also adjustable as to its initial unstretched length for additional adjustability. By sliding the rings of the slip ring assembly 44 away from one another, a section of the tensioning member 32 may be slid through both rings and either reduce the length of the stretchable cord 39 or increase the length as desired. The adjustable loop 38 will increase or decrease accordingly. It will be appreciated that this tensioning member 32 adjustment procedure could be performed with the training device 30 worn or unworn.

Figure 5:
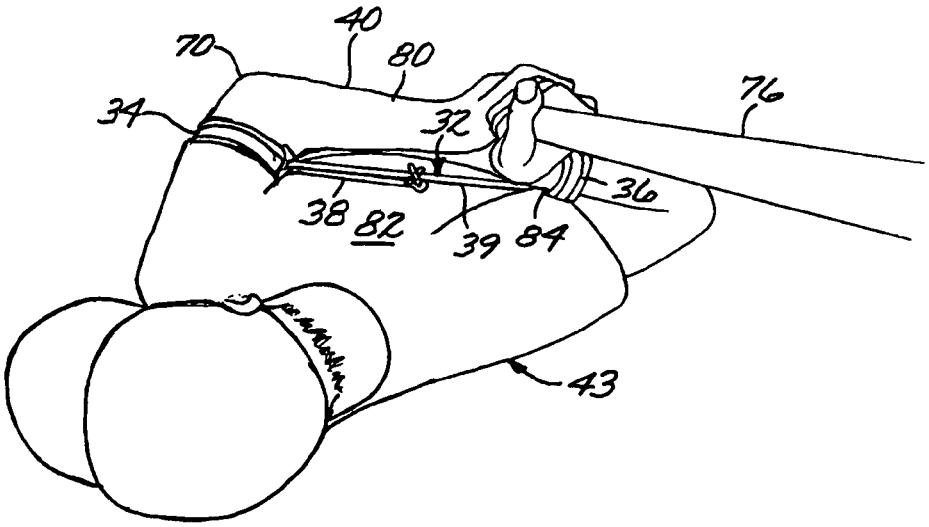
FIG. 5 is a partial top view, in enlarged scale, of a batter in an initial batter's stance and wearing the preferred embodiment of the present invention.

While the incorporation of a bat 76 into the swing training procedure is not necessary to develop the desired muscle memory it assists in a more realistic feel for actual game situations and thus the remaining portion of the swing process will assume the batter 43 is grasping a baseball bat 76 in a conventional fashion as is shown in FIG. 6 for illustrative purposes. With both hands on the bat and the second set of knuckles 78 substantially aligned, the tensioning member 32 will be positioned in a relationship with the forearm 80 of the batter's leading arm 40 (FIGS. 5 and 6). At this time, there is little if any tension in the tensioning member 32.

Figure 8:
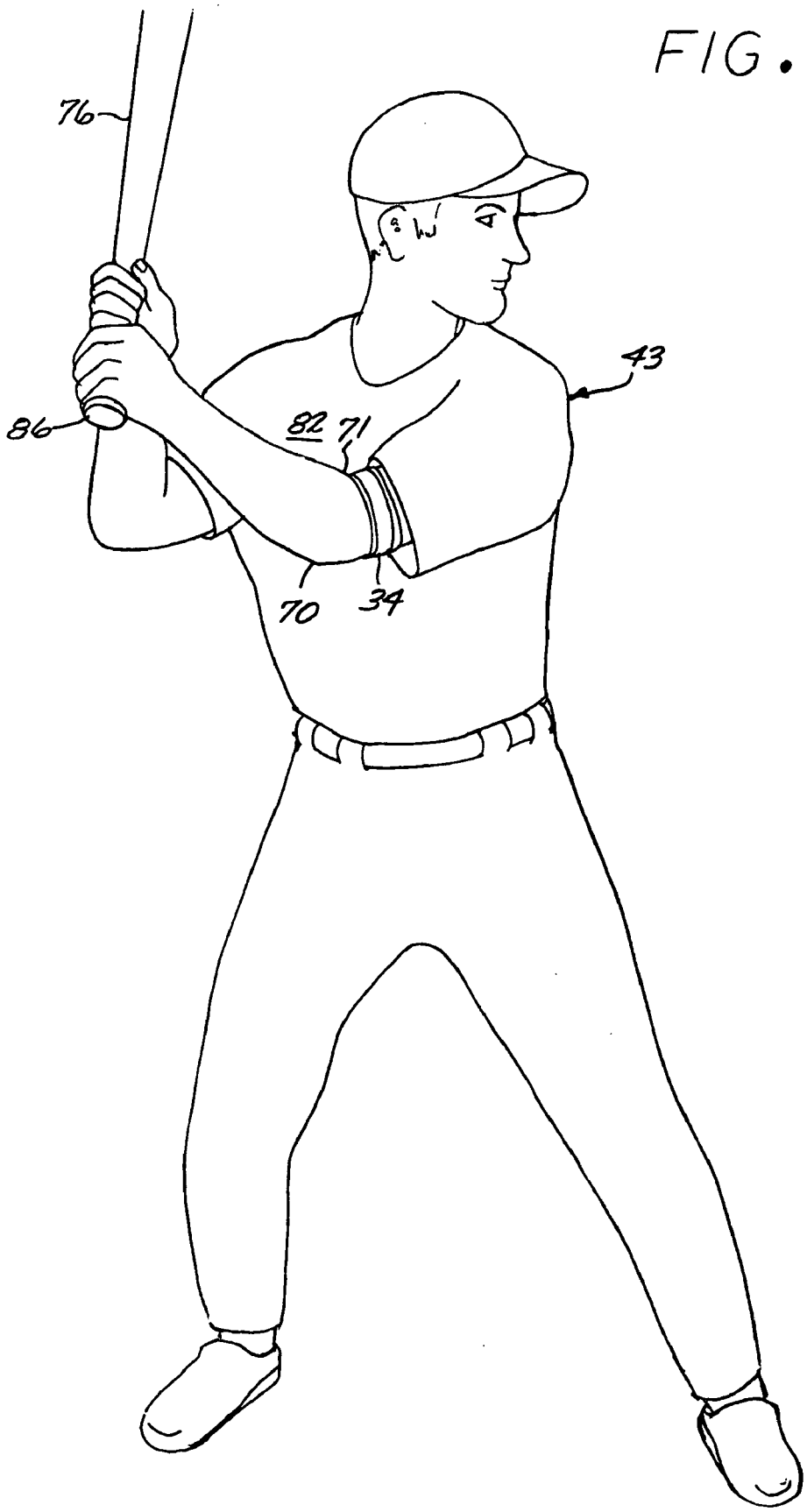
FIG. 8 is a front view of a batter assuming an initial batter's stance and wearing the preferred embodiment of the present invention.
Figure 9:
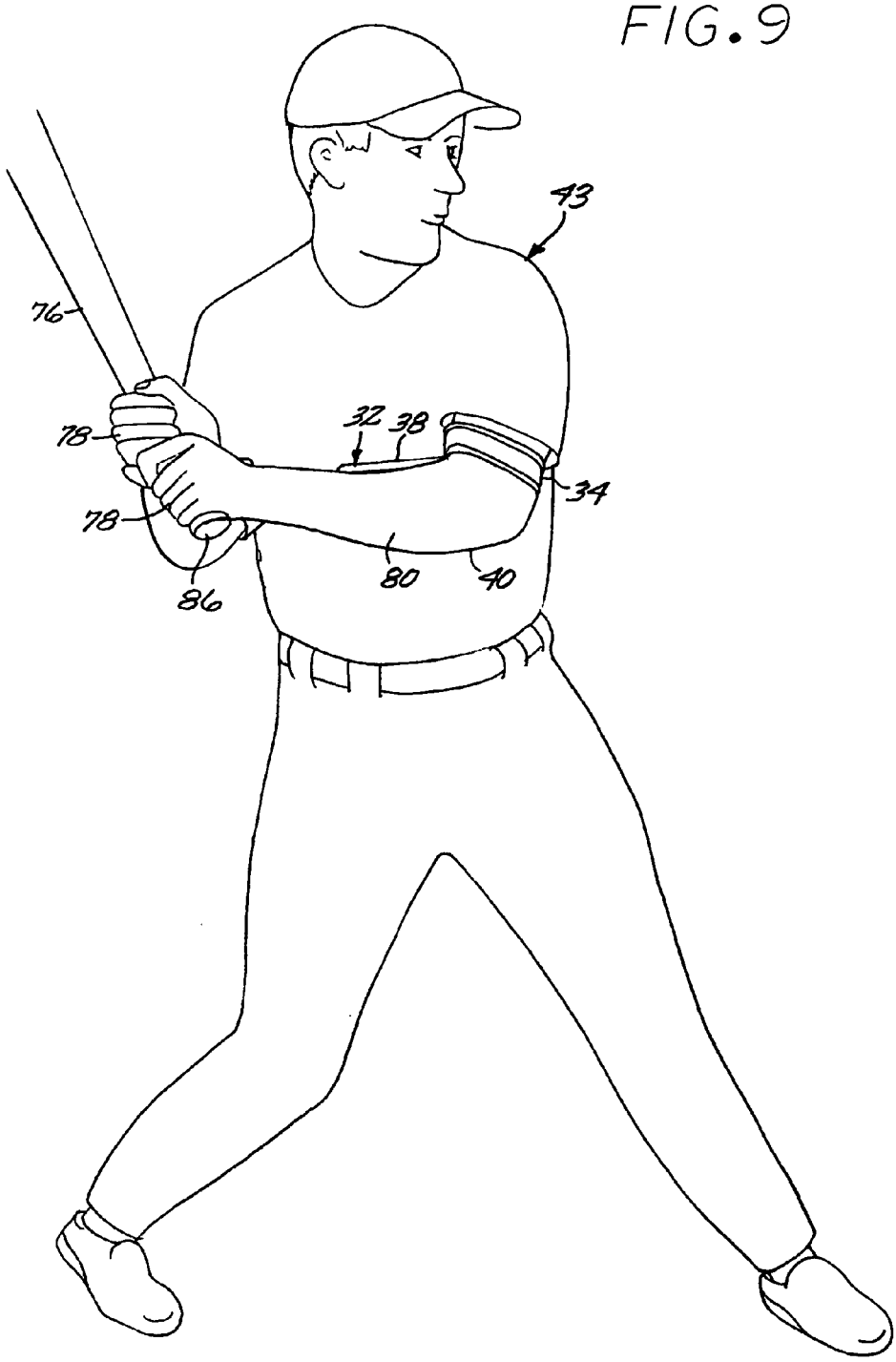
FIG. 9 is a front view of the batter shown in FIG. 8 beginning a swing motion.

Referring now to FIGS. 5 and 8, the batter 43 assumes the initial starting position or "loaded" position. In this position, the bat 76 is in a substantially vertical position and both hands have been brought up to the batter's chest 82 and moved rearwardly away from the direction of a pitcher (not shown). Typically, the batter's feet will point forwardly and flare slightly outwardly away from the batter's vertical centerline. In the loaded position, the elbows are flared outwardly as well thereby stretching the tensioning member 32 and inducing tension along its length. The hands are tucked up tight against the body and are positioned proximate the rearmost armpit 84. As seen from above as in FIG. 5, the tensioning member 32 is substantially parallel with the leading forearm 80. Thus, the batter 43, when in the loaded position, may simply look down to view the tensioning member 32 the relationship with the leading forearm 80. This is an illustration of a substantially correct starting position.

On the other hand, if the batter 43, while in the loaded position, looks down and sees that the tensioning member 32 is not substantially parallel with the leading forearm 80, as illustrated in FIG. 7, then an adjustment is required. A typical reason for such misalignment is that the second set of knuckles 78 on the batter's respective hands are not substantially aligned. A slight adjustment bringing the second set of knuckles into alignment results in the parallel relationship between the tensioning member 32 and the leading forearm 80. Advantageously, the training device 30 provides an early indication that the subsequent swinging motion may not be optimized by providing a relationship between the tensioning member 32 and leading forearm 80 easily visible to the batter 43. While the correct grip is a positive precursor to the remainder of the swing, additional points along the batter's swing are critical as well such as the initial motion in reaction to the pitcher's motion.

While in the proper starting position (FIGS. 5, 6 and 8), the increased length of the tensioning member 32 between the leading arm 40 and the trailing wrist 74 presents a tensile force perceivable to the batter 43 drawing the batter's elbows inwardly. The first motion of the batter 43, upon initiating the swing, is to move the leading arm 40 in a linear motion across the chest region 82 toward the pitcher. The connection between the leading arm 40 and trailing wrist 74 via the tensioning member 32 ensures the trailing arm 42 will follow the leading arm 40 in the same linear motion across the chest 82 of the batter 43 initially. Advantageously, this reduces the tendency to develop a "casting" motion or move the hands away from the body instead of across the chest 82. As it is desirable to avoid full arm extension prior to reaching the back of home plate with the bat 76, the training device 30 advantageously prevents the undesirable casting motion which introduces arm extension prior to the appropriate point in a desirable swing position.

Once a correct starting position is indicated (FIGS. 5 and 6), the batter 43 may begin either a practice swing to begin build muscle memory imparting a short compact swing or actually hit baseballs hurled by a pitcher or batting machine. Referring now to FIGS. 9 through 14, the batter 43 will begin to drive the knob 86 of the bat 76 toward the inside of an imaginary or real baseball flight path. At this point the bat 76 is moving in a substantially linear direction and the shoulders and upper torso begin to turn toward the pitcher. The parallel relationship between the tensioning member 32 and the leading forearm 80 is substantially maintained up through this point in the swing.

Figure 10:
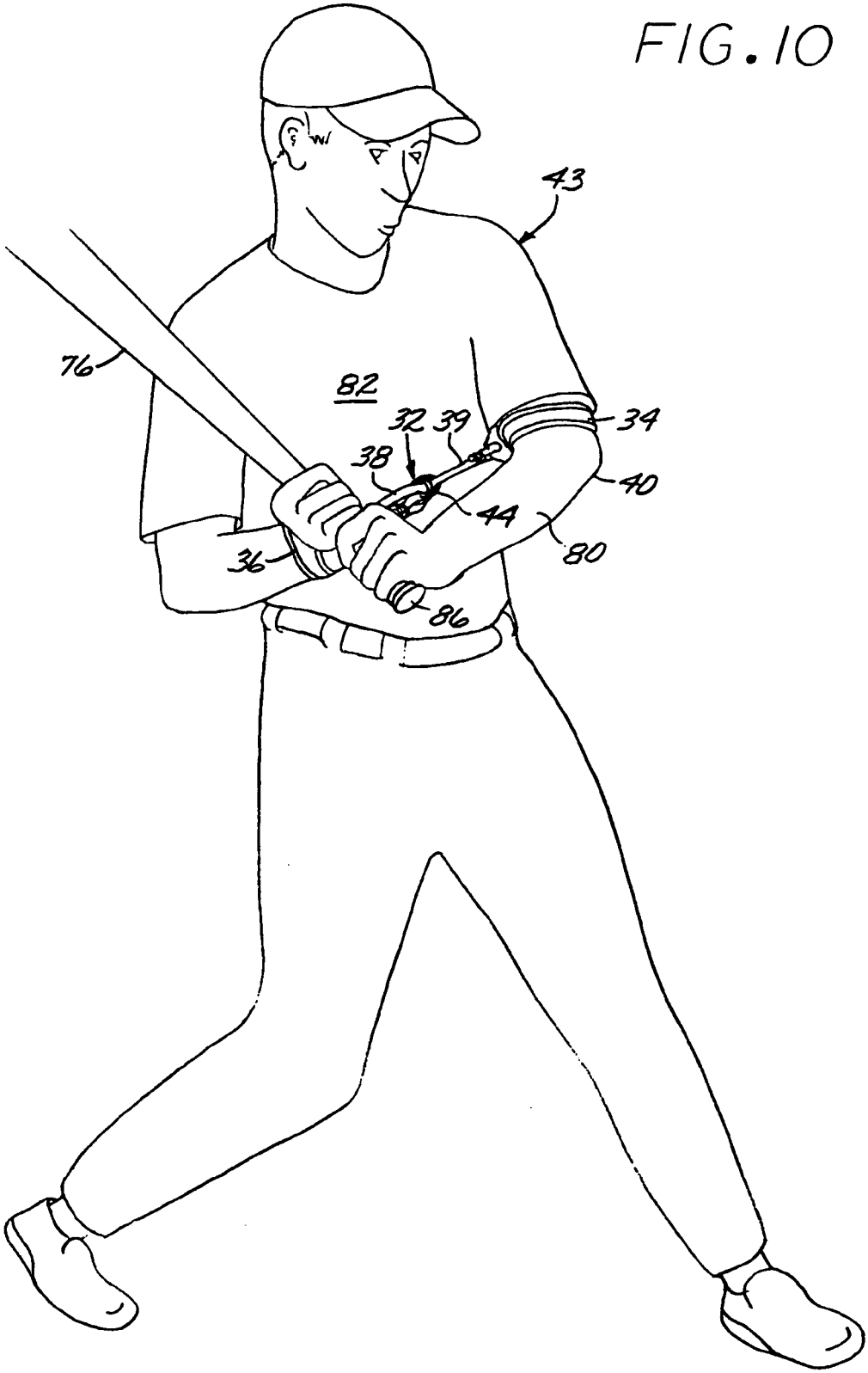
FIG. 10 is a front view of the batter shown in FIG. 8 in a quarter swing position.

Referring now to FIG. 10, the batter 43 has turned further toward facing the pitcher including continuing turning the torso 82 to face the pitcher and bringing the hips around as well. The knob 86 of the bat 76 is still being driven toward a spot slightly inward of the path of the ball (not shown). The trailing wrist 74 and leading elbow 70 move closer together as the hands begin to extend away from the body. The inward motion of the trailing wrist 74 and/or leading elbow 70 decreases the length of the tensioning member 32 reducing the tension imparted to the batter 43 by the training device 30. At this point, no tension is needed and the batter 43 progresses through the swing motion in a normal manner preparing to make contact with the ball while continuing to rotate toward the contact point. The batter 43 has avoided any casting motion.

Figure 11:
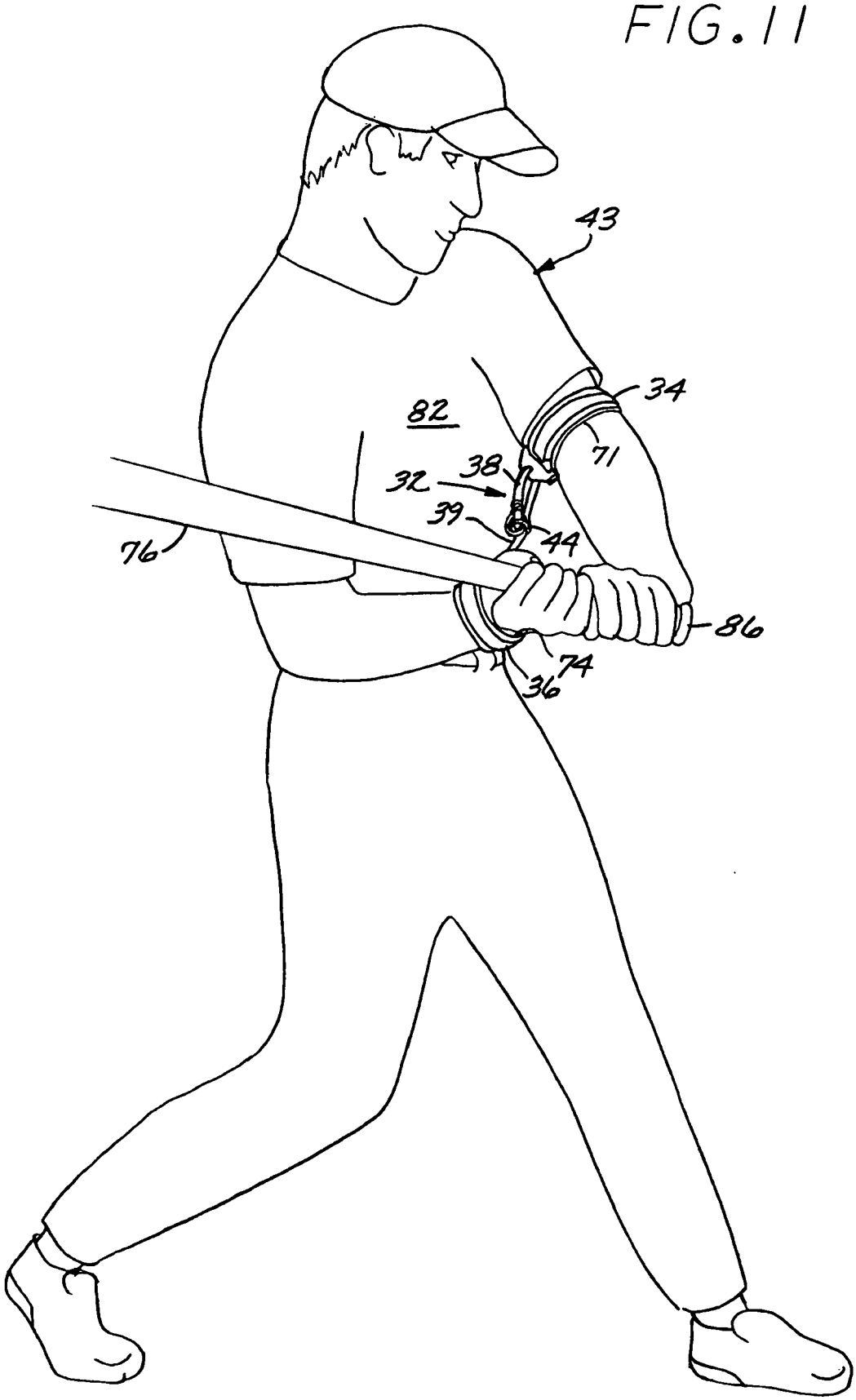
FIG. 11 is a front view of the batter shown in FIG. 8 just prior to striking a baseball.

Referring now to FIG. 11, illustrating a swing position slightly prior to contact with the ball. The knob 86 of the bat 76 has been driven to slightly inside the path of the ball and the batter 43 is preparing to snap the top or trailing wrist 74 through and "hammer" through the ball. In other words, the batter's leading hand is palm down and the trailing hand is palm up as the wrists begin to rotate in relation to the respective forearm and induce a rotational motion and acceleration into the bat 76 bringing the contact surface of the bat 76 into a fully extended position. The hands have essentially ceased moving away from the body as the leading arm 40 is substantially straightened out. The tip of the bat 76 begins to travel in an arc as opposed to the previous linear motion produced in the earlier stages of the swing. The acceleration of the bat tip increases the impact force placed on the ball. This swing provides the shortest distance for a quicker swing speed while producing significant acceleration at the point of contact.

Figure 12:
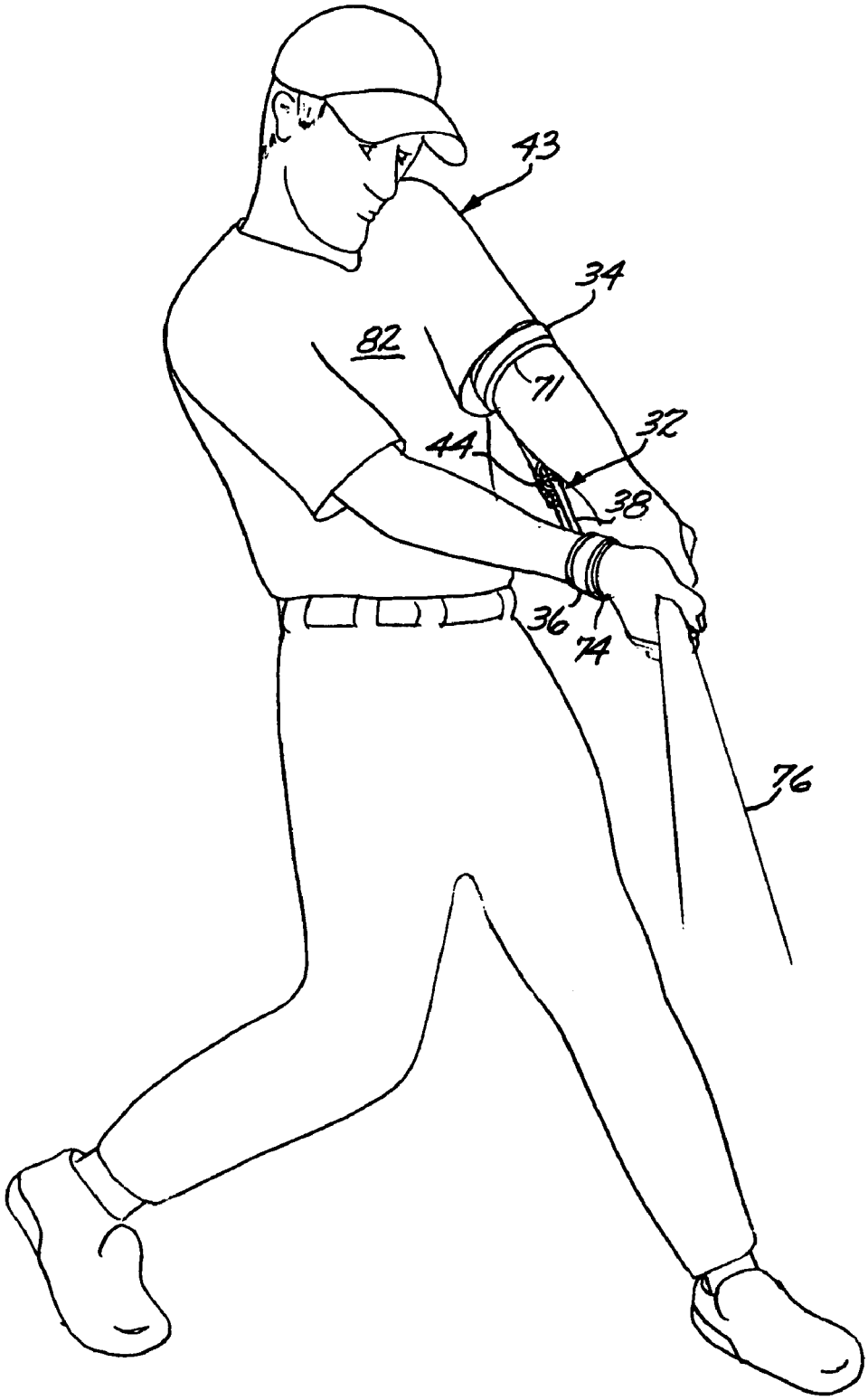
FIG. 12 is a front view of the batter shown in FIG. 8 in a full contact position.

FIG. 12 illustrates the batter's swing position at the contact point with the ball. As the trailing arm 42 enters into a straightened positioned substantially locking the elbow, the tensioning member 32 is again stretched a second time inducing tension between the attachment members 34 and 36. Due to the connection between the leading arm 40 and the trailing arm 42 and travel path of the arms, the tensioning member 32 pulls on the second attachment member 36 located on the trailing wrist 74 to pull the trailing hand through the contact point and snap the wrist 74 through causing the bat to travel in a rapid fashion through an arc imparting significantly improved swing acceleration to the bat 76 through the contact point to drive the ball its maximum distance.

Figure 13:
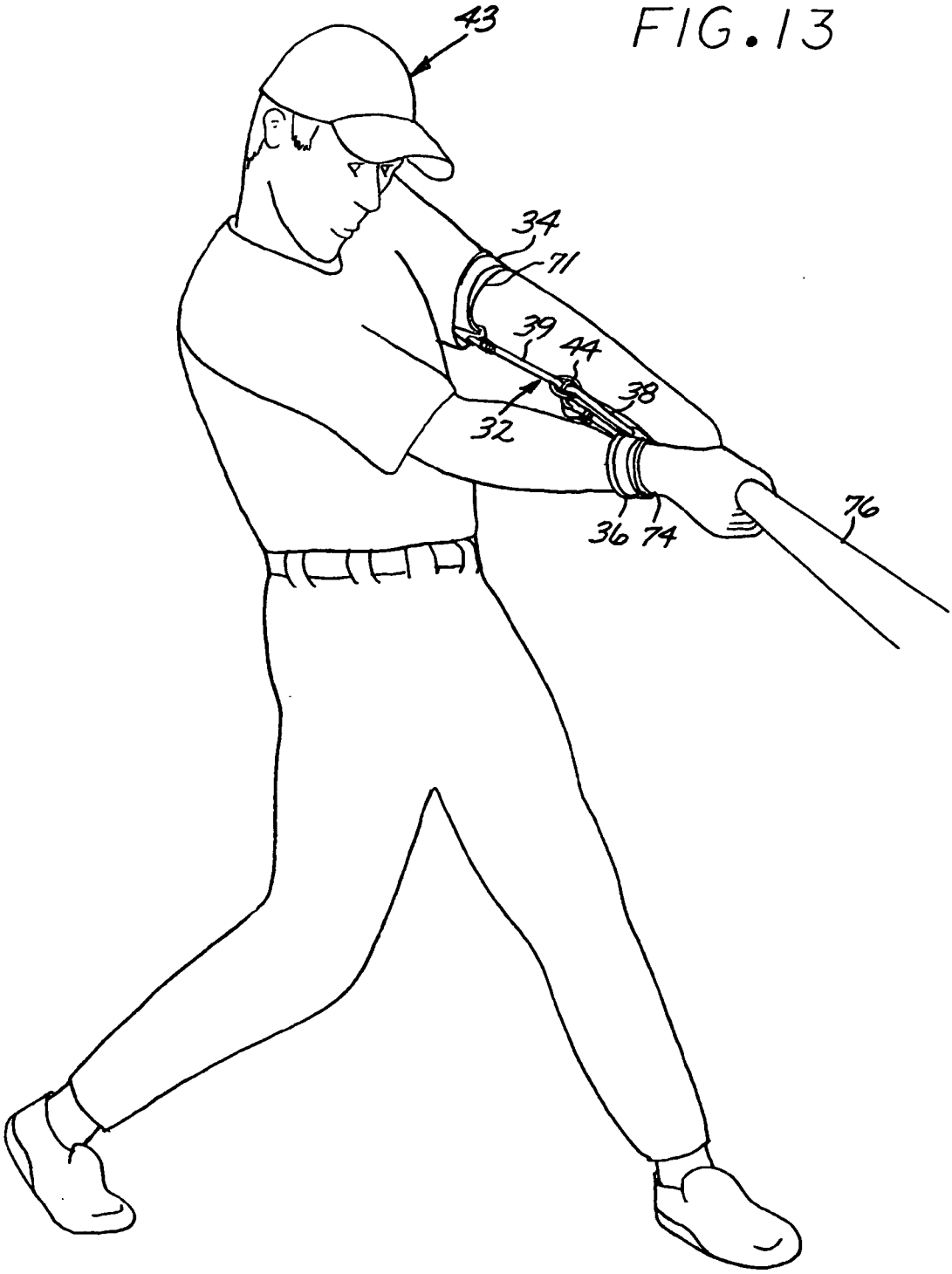
FIG. 13 is a front view of the batter shown in FIG. 8 in a three-quarter swing position.

Referring now to FIG. 13, the batter 43 continues with the follow through as the trailing wrist 74 of the top hand is straightened out as the trailing arm 42 is also straightened out fully extending the reach of the bat 76 which forms an outwardly projecting extension of the leading arm 40. At this point the tensioning member 32 is again taut and substantially parallel to the leading forearm 80.

Figure 14:
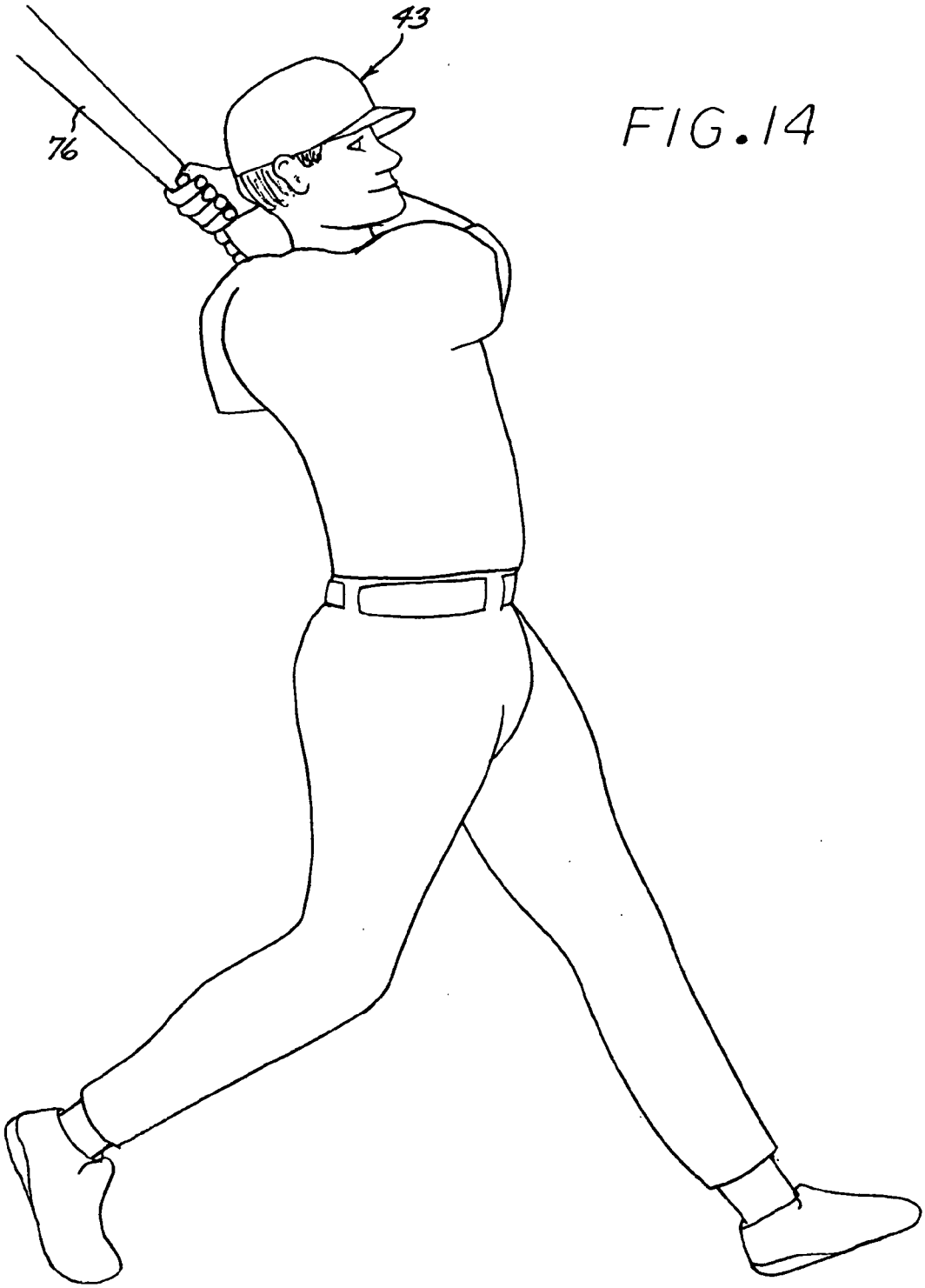
FIG. 14 is a front view of the batter shown in FIG. 8 completing the swing.

A continued follow through to the end of the swing motion with the leading arm 40 and trailing arm 42 coming together and the intermediate member 32 is slackened and does not interfere with the normal follow through (FIG. 14).

It will be appreciated that the tensioning member 32 does not interfere with the swing of the batter 43 but instead provides feedback at three key points along the batter's swing including the initial loaded position, initial swing motion across the chest 82, and just prior to the top hand hammer through prior to and during contact with the ball. By providing such feedback, the proper motion is reinforced at critical points along the swing to build muscle memory of the correct swing over repeated training sessions. At other less critical points along the swing the tensioning member is slack and does not interfere with the batter's swing motion.

Continued usage of the training device 30 builds muscle memory and proper swing motion such that the batter 43 will develop an improved swing that eventually becomes the batter's natural swing even without using the training device 30. Advantageously, the short compact swing developed by training with the training device 30 reduces the time between the start of the swing and the contact point by enforcing muscle memory to avoid unnecessary or wasted motion providing a swing with the shorter distance to the contact point. The reduction of unnecessary or sloppy motion provided by the in tight motion increases the bat control resulting in increased accuracy of the bat placement as well. Additionally, by shortening the swing path the batter 43 is able to view the ball longer after being pitched enabling more selective positioning of the striking center of the bat to place or drive the ball with greater accuracy.

While several forms of the present invention have been illustrated and described, it will also be apparent that various modifications may be made without departing from the spirit and scope of the invention.

What is claimed is:

1. A batting swing training apparatus for maintaining a batter's arms in the proper special alignment during the swing comprising:

an elongated, elastic tensioning member formed of a single piece having a predetermined length and having first and second opposing ends, said tensioning member having said first end slidably attached to said tensioning member at an intermediate point along said length forming a stretchable adjustable loop for varying the tension in the tensioning member;

a first adjustable attachment member including a first connector connected directly to a portion of said adjustable loop, said first attachment member being dimensioned to form an upper arm loop for attachment to the lead arm of the batter at a point above the elbow during use; and a second adjustable attachment member dimensioned to form a wrist loop for attachment to the wrist of the trailing arm of the batter during use and including a second connector connected directly to said second end of said tensioning member elastically coupling said second adjustable attachment member to said first adjustable attachment member with said entire tensioning member being stretchable along its length between said first and second connectors.

2. A swing training apparatus for connecting to a batter's lead and trailing arms comprising:

an elongated one-piece intermediate member having a first portion including a first end attached to said intermediate member at an intermediate position to form an adjustable stretchable loop and a second stretchable portion having an unstretched predetermined length terminating in an opposing second end, said intermediate member including a pair of slip rings for adjusting an elongated length of said loop;

a leading arm coupling having a first link of a predetermined adjustable diameter and including a pair of opposing free ends with complementary fasteners constructed to be brought together in overlapping arrangement to be circumferentially secured about the batter's lead arm, said leading arm coupling being connected to one of said portions of said intermediate member by a first retaining clip;

a trailing arm coupling having a second link with an adjustable diameter to a maximum diameter of less than said predetermined diameter and including a pair of free ends with complementary fasteners constructed for overlapping arrangement to be circumferentially secured about the batter's trailing arm, said trailing arm coupling being connected to the other of said portions of said intermediate member by a second retaining clip;

a cushioning pad concentrically aligned with the radial interior of each of said arm couplings for placement against the arms of the batter; and wherein said batter may build muscle memory for an improved swing by strapping said leading arm coupling to the batter's leading arm in an abutting relationship with the batter's elbow pit and strapping said trailing arm coupling to the batter's trailing arm in an abutting relationship with the batter's wrist and then assuming an initial batting stance so that said second portion of said intermediate member is stretched into a length greater than said predetermined length in a direction substantially parallel to the length of the leading forearm to exert a tension between said trailing and leading arms so that the batter's first motion will be a linear movement across the chest.

* * * * *

UNITED STATES PATENT AND TRADEMARK OFFICE

CERTIFICATE OF CORRECTION

PATENT NO. : 6,984,184 B2
DATED : January 10, 2006
INVENTOR(S) : D. Gray

It is certified that error appears in the above-identified patent and that said Letters Patent is hereby corrected as shown below:

Column 8,
Lines 46 and 47, delete "formed of a single piece".

Signed and Sealed this

Eighteenth Day of April, 2006

JON W. DUDAS
*Director of the United States Patent and Trademark Office*